US008635811B2

(12) United States Patent
Horton

(10) Patent No.: US 8,635,811 B2
(45) **Date of Patent: *Jan. 28, 2014**

(54) SCREENED GUTTER PROTECTION

(75) Inventor: James W. Horton, Yulee, FL (US)

(73) Assignee: Southeastern Metals Manufacturing Company, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 13/529,379

(22) Filed: Jun. 21, 2012

(65) Prior Publication Data

US 2013/0152484 A1 Jun. 20, 2013

Related U.S. Application Data

(63) Continuation of application No. 12/573,130, filed on Oct. 4, 2009, now Pat. No. 8,474,192.

(60) Provisional application No. 61/104,866, filed on Oct. 13, 2008, provisional application No. 61/151,489, filed on Feb. 10, 2009.

(51) Int. Cl.
*E04D 13/00* (2006.01)

(52) U.S. Cl.
USPC ..... 52/12; 52/11

(58) Field of Classification Search
USPC ..... 52/11, 12
See application file for complete search history.

(56) References Cited

U.S. PATENT DOCUMENTS

| | | | | |
|---|---|---|---|---|
| 4,418,504 | A | 12/1983 | Lassiter | |
| 4,769,526 | A * | 9/1988 | Taouil | 219/213 |
| 4,937,986 | A * | 7/1990 | Way et al. | 52/12 |
| 4,941,299 | A * | 7/1990 | Sweers | 52/12 |
| 4,959,932 | A * | 10/1990 | Pfeifer | 52/12 |
| 5,072,551 | A * | 12/1991 | Manoogian, Jr. | 52/12 |
| 5,406,754 | A * | 4/1995 | Cosby | 52/12 |
| 5,640,809 | A * | 6/1997 | Iannelli | 52/12 |
| 5,842,311 | A * | 12/1998 | Morin | 52/12 |
| 7,191,564 | B2 * | 3/2007 | Higginbotham | 52/12 |
| 7,310,912 | B2 * | 12/2007 | Lenney et al. | 52/12 |
| 7,913,458 | B2 * | 3/2011 | Higginbotham | 52/12 |
| 7,950,187 | B2 * | 5/2011 | Iannelli | 52/11 |
| 8,037,641 | B2 | 10/2011 | Gerig | |
| 2006/0179723 | A1 * | 8/2006 | Robins | 52/11 |
| 2008/0127575 | A1 * | 6/2008 | Ealer | 52/12 |

OTHER PUBLICATIONS

Gutter Oportunities, A supplement to Metal Roofing, p. 21, dated Summer 2006.
Mastershield advertisement, Qualified Remodeler, p. 51, dated Sep. 2005.
Mastershield advertisement, copyright 2005.
Grater gutter guard, purported to be dated May 18, 2006.

* cited by examiner

*Primary Examiner* — Adriana Figueroa
(74) *Attorney, Agent, or Firm* — Jennifer Meredith, Esq.; Lippes, Mathias, Wexler, Friedman, LLP

(57) ABSTRACT

System, device and method for providing screened protection to gutters from clogging debris. Protection is provided by using a panel that includes rain siphoning louvered technology covered by a filter or screen. The rows of louvers are offset to direct water into the vertical openings. The louvered portion is dome shaped to permit the louvers to be vertical and to help debris roll off the sides. The filter is molded to the rows of louvers to conduct water to the vertical openings of the louvers. The filter or screen is secured to the panel by being laid in opposing hems on the two sides of the louvered portion of the panel and then by rolling beads or ribs onto the hemmed portions.

17 Claims, 18 Drawing Sheets

1003

Method for making a screened gutter protection system

Gutter protection method

4001

4002 photograph of a molded filter screen design
for a screened gutter protection system photograph of one method of molding
the molded filter screen design photograph of the louvered rows and the gutter below photograph displaying the installation of the panel beneath the shingle and above the gutter photograph of an end view of a gutter protection system showing a profile of the screen photograph taken from beneath the panel
of the gutter protection system photograph of the gutter protection system showing the rolled screen locking bead mechanisms

SCREENED GUTTER PROTECTION

CROSS-REFERENCE TO RELATED APPLICATIONS

The present application is a continuation and claims priority to co-pending patent application Ser. No. 12/573,130 filed Oct. 4, 2009 which in turn claims the benefit of the U.S. Provisional Patent Applications No. 61/104,866 and No. 61/151,489, filed in the United States Patent and Trademark Office respectively on Oct. 10, 2008, and Feb. 19, 2009, the entire contents of which are incorporated herein by this reference.

BACKGROUND OF THE INVENTION

1. Field of the Invention

The present invention pertains generally to the field of gutters and, more particularly, to protecting gutters from collection of debris.

2. Description of Related Art

Gutter debris has the potential to clog the gutters and presents various problems. Obstructed gutters and downspouts prevent rain water and melting snow from flowing through the gutter system. Water that cannot flow freely can back-up and overflow the gutter causing damage to the landscaping and the foundation. Damage to the roof line and the fascia board may also occur if water gets behind the gutter. Cleaning of the gutters from ladders or by climbing on the roof is dangerous.

BRIEF SUMMARY OF THE INVENTION

Gutter protection devices are needed to help maintain a clean, free flowing gutter and reduce the time spent on ladders and the risk associated with working from a ladder. Aspects of the present invention provide methods, devices and systems for protecting gutters from collection of debris and the problems that are associated with clogging of the gutters by the collected debris.

In one aspect of the present invention, protection for the gutter from clogging debris is provided by using a panel that includes rain siphoning louvered technology covered by a filter, screen or a filter screen. The louvers include substantially vertical openings. The vertical openings are vertical to a surface of the panel and lead to horizontal openings as opposed to being openings merely on the surface of the panel. Vertical openings are less susceptible to the penetration of debris. The rows of louvers may be offset to direct water around the louvers and into the openings. The louvered portion is dome shaped to permit the louvers to be substantially vertical and also to help debris roll off the sides of the panel. The filter, screen or filter screen may be made from a stainless steel micro mesh and is molded to the rows of louvers to conduct water to the vertical openings of the louvers. The filter, screen or filter screen may be secured to the panel by being laid into hems on the two opposing sides of the louvered portion of the panel to obtain hemmed portions. Accordingly, the securing of the filter to the panel is obtained without using glue. Moreover, the filter may be further secured to the hems in the panel by rolling ribs (roll formed ribs) onto the hemmed portions. On one side, the panel may end in alignment ribs that are used to align the gutter protection system under the roofing material.

One aspect of the present invention provides a system for protection of a gutter from debris collection. The system includes a panel, and a screen connected to the panel. The panel includes louvers in a louvered portion of the panel, and the louvers provide openings to the gutter below. The openings are substantially vertical with respect to a panel surface, and the screen is molded over the louvers. The panel may include an outer portion fitting over a lip of the gutter, a first hemmed portion for connecting a first edge of the screen to the panel and extending from the outer portion, the louvered portion extending from the first hemmed portion, a second hemmed portion for connecting a second edge of the screen to the panel and extending from the louvered portion, and an extension portion of the panel for fitting the panel on a roof and extending from the second hemmed portion. The panel may be made from a continuous sheet, and beads may be rolled onto the first hemmed portion and the second hemmed portion. The louvers may be arranged in offset rows of louvers. The extension portion of the panel may include alignment ribs for mounting the panel on a fascia. The louvered portion of the panel may be dome-shaped and the screen may be convex. The system may be installed at an angle with respect to horizontal to facilitate rolling off of debris. The panel may be made from metal and the screen may be stainless steel.

In one aspect, the present invention provides a screened gutter protection device for being mounted on a roof and fitting over a gutter and for protecting the gutter from collection of debris. The device includes a panel including louvers, the louvers having openings being substantially vertical with respect to panel surface, and a filter screen set in hemmed portions on opposing sides of the panel and secured to the panel by rolled screen locking beads at the hemmed portions. The filter screen is molded over the louvers. The louvers are formed in a louvered portion of the panel and the panel may be dome shaped in the louvered portion and the filter screen is convex, and the louvers may be arranged in offset rows of louvers. The panel may include an outer portion for fitting over an outer lip of the gutter, a first rolled screen locking bead for holding a first edge of the filter screen to the panel and extending from the outer portion, a louvered portion of the panel including the louvers and extending from the first rolled screen locking bead, a second rolled screen locking bead for holding a second edge of the filter screen to the panel and extending from the louvered portion, and a ribbed extension adapted for fitting over a roof and extending from the second rolled screen locking bead. The panel may be made from a continuous sheet of material that is made from heavy gauge 0.024 aluminum and is coated with paint. The filter screen may be made from stainless steel micro mesh.

One aspect of the present invention provides a method for making a screened gutter protection system. The method includes forming a panel, and attaching a screen to the panel. The panel may be formed by forming an outer portion for fitting over an outer lip of a gutter, a first hemmed portion for holding a first edge of the screen to the panel and connected to the outer portion, louvers having openings substantially vertical to a surface of the panel in a louvered portion of the panel being connected to the first hemmed portion, a second hemmed portion for holding a second edge of the screen to the panel and connected to the first rolled screen, and a ribbed extension adapted for fitting over a roof and connected to the second hemmed portion. The method may further include molding the screen to the louvered portion of the panel. The attaching of the screen to the panel may include laying a first side of the screen in the first hemmed portion and a second side of the screen in the second hemmed portion, and rolling beads onto the hemmed portions. The panel may be formed from a continuous sheet of material. The panel may be dome shaped in the louvered portion and the filter screen is convex, and the louvers are arranged in offset rows of louvers.

One aspect of the present invention provides a method of installing a gutter protection system for a gutter. The method includes determining a type and a size of the gutter, determining a required number of gutter protection components, and installing the gutter protection components to form the gutter protection system. The gutter protection system includes a panel including louvers, the louvers having openings being substantially vertical with respect to panel surface, and a filter screen set in hemmed portions on opposing sides of the panel and secured to the panel by rolled screen locking beads at the hemmed portions, wherein the filter screen is molded over the louvers.

DETAILED DESCRIPTION OF THE INVENTION

Aspects of the present invention provide a gutter protection system, device and method. The gutter protection system and device of the aspects of the present invention include a screen, filter, or filter screen that covers a panel portion of the gutter protection system to yield a screened gutter protection system and device. The gutter protection method of the aspects of the present invention provides a method of making and a method of installing the screened gutter protection system and device of the aspects of the present invention.

The screened gutter protection device, method and system of the aspects of the present invention provide several benefits. They keep leaves, pine needles, seeds and stone granules out of the gutter. They eliminate or reduce clogging in the gutter systems and the associated cleaning processes that tend to be dangerous. Some aspects use a novel louvered technology adapted for siphoning rain. Some aspects use vertical louvered openings arranged in rows that are offset with respect to one another to enhance drainage. Some aspects may be presented in different colors including white, brown, bronze and charcoal. Some aspects may be installed beneath the first row of shingles using substantially invisible or barely visible installation. Some aspects fit on most existing gutter systems. Some aspects include molded filter screen that channels the rain flow into the gutter through the vertical openings in the louvers. Some aspects include a panel that has alignment ribs for alternate 5K and 6K fascia mounting. The alignment ribs also provide stiffening and strengthening of the panel. Some aspects may be used for screen rooms or pool cage super gutters. Some aspects may be installed on any type of roofing including slate, steel or tile. Some aspects may be installed at a slight angle to help debris roll off by wind or rain. Some aspects include a screen, filter, or filter screen that is made from stainless steel micro mesh that filters rain water from debris. Some aspects are capable of handling significant volumes of water.

In general, gutter protection system installations begin with an inspection of the gutters to confirm the amount of material required, and also to determine the best method of installation. When a protection system is to be installed for gutter protection, prior to the installation, the gutters are cleaned and tested to ensure that they are free of clogs and in proper working order. Installation of gutter protection devices and systems and other procedures are carried out after it is determined that the gutter is ready for the gutter protection system.

Figure 1A:
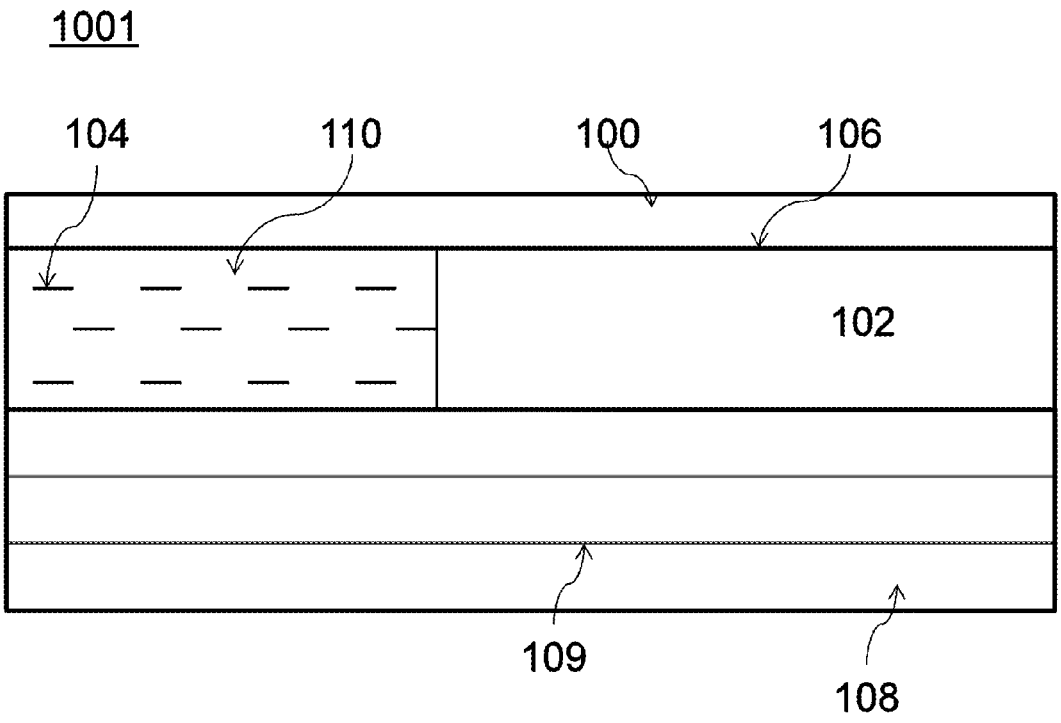
FIG. 1A shows a plan view of the gutter protection system, according to the aspects of the present invention.
Figure 1B:
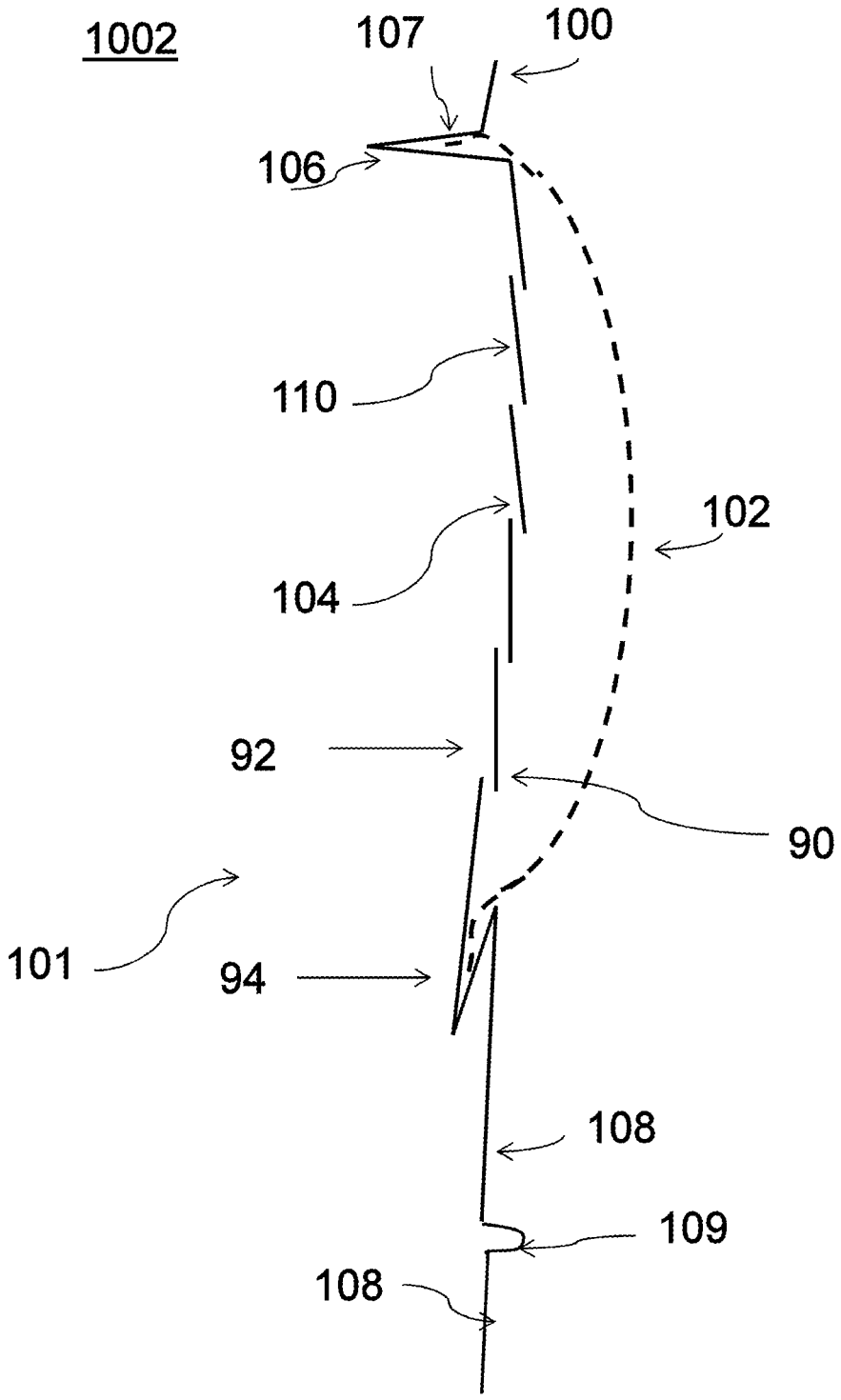
FIG. 1B shows a side view of the gutter protection system, according to the aspects of the present invention.

FIG. 1A and FIG. 1B show a plan view and a side view of the gutter protection system, according to the aspects of the present invention.

View 1001 in FIG. 1A shows a plan view of the gutter protection system, according to one aspect of the present invention. The gutter protection system includes a panel that is partially covered by a screen, filter or filter screen. The panel is continuous and begins with an outer edge or outer portion 100 leading to a locking bead 106, a louvered portion 110 and a ribbed extension 108. The screen 102 covers the louvered portion 110 of the panel and is secured to the panel on two sides of the louvered portion 110 along the outer portion 100 and along the extension 108.

The louvered portion of the panel 110 includes the louvered rows 104. The screen 102 covers the louvers. The extension 108 includes alignment ribs 109 and lies on the roof while the outer portion 110 is secured to the outer edge or lip of the gutter away from the roof.

Figure 11:
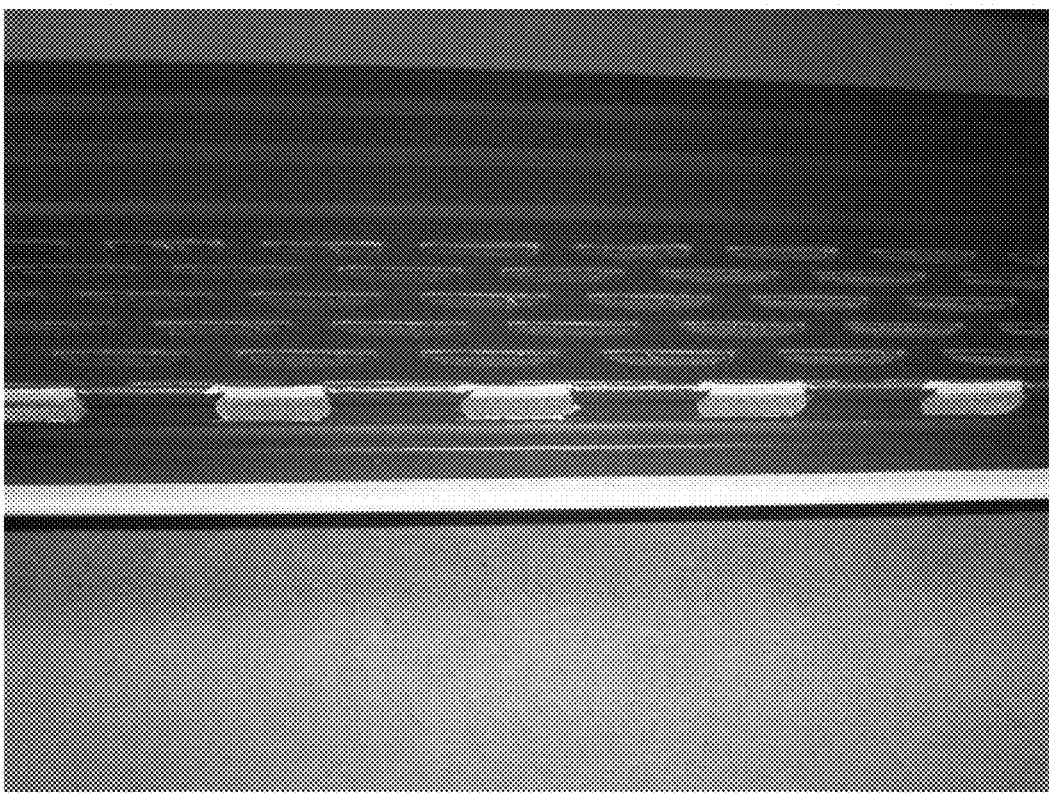
FIG. 11 shows a photograph taken from beneath the panel of the gutter protection system, according to the aspects of the present invention.

View 1002 in FIG. 1B shows the same elements from a side view. The locking bead 106 is formed such that any weep holes that are formed by the locking bead are unobstructed. As shown in FIG. 1B, there is a panel (101); and a screen (102) connected to the panel (101), wherein the panel includes at least one row of raised louvers in a louvered portion of the panel, the louvers (90) providing openings to the gutter below, the openings being substantially upwardly vertical with respect to a panel surface (92). The panel surface (92) may be the underside of the panel as depicted in FIG. 11. The panel includes: an outer portion (100) fitting over a lip of the gutter, a first hemmed portion (107) for connecting a first edge of the screen to the panel and extending from the outer portion (100), wherein said first hemmed portion (107) is substantially vertical, the louvered portion (110) extending from the first hemmed portion (107), a second hemmed portion (94) for connecting a second edge of the screen (102) to the panel (101) and extending from the louvered portion (110), and an extension (108) portion of the panel (101) for fitting the panel (101) on a roof and extending from the second hemmed portion (94). The extension (108) portion of the panel (101) having at least one alignment rib (109).

Some aspects of the system of the present invention may be used for commercial buildings and other applications where the use of brackets and reverse curve technology impedes installation.

In some aspects of the present invention, a convex screen design readily sheds the debris. This convex design can be observed from the profile of the screen 102 in FIG. 1B. In one aspect of the present invention, the screen, filter, or filter screen may be implemented using a stainless steel micro mesh and the louvers may be implemented using a vortex louver system. Either of these two implementations, as well as the combination of the two, draws rainwater into the gutter while substantially preventing the debris from entering. The system is substantially impermeable to even small particles, such as shingle, grit and pollen.

In one aspect of the present invention, the screen, filter or filter screen may be constructed from heavy gauge 0.024 aluminum material to maximize strength and is coated with an industrial Kynar® paint system to preserve the finish. Kynar® is a registered trademark of ARKEMA Inc., 2000 Market Street, Philadelphia, Pa. 19103, USA.

In one aspect of the present invention, the screen, filter or filter screen may be constructed of Micro-CS™ which is a trademark of Gutter Helmet® which is in turn a registered trademark of the Southeastern Metals Mfg. Co., 11801 Industry Drive, Jacksonville, Fla. 32218, USA. The size of contaminants and particles that the stainless steel mesh traps are usually described in microns, a metric unit of measure where one micron is one-millionth of a meter. There are 25,400 microns in one square inch. The eye can see particles to about 40 microns. The 40/40 stainless steel Screen Mesh with 0.0065 wires provides approximately 1600 individual openings per square inch of 0.0185"×0.0185" Ea. or approx. 470 microns of filtration. The panels siphoning louvered sections including weep holes provide a clear net free area per Lineal Foot of panel of approx. 4.08 square inches.

While, in one aspect of the present invention, the panel may be formed from one continuous sheet of material and connected to the screen through locking beads, in other aspects, the various parts of the panel may be formed from separate material and later connected together. For example, the louvered portion may be formed separately and connected to the screen and the combination of the louvered portion and the screen may be later connected to the ribbed extension portion.

In some aspects of the present invention, the screen may be connected to the louvered portion through means other than the locking beads.

The louvered technology including the substantially vertical openings, the molding of the screen to the louvered portion, the hemmed and rolled locking bead connection of the screen to the louvered portion, the domed shape of the louvered portion, the convex nature of the screen that is fitted over the domed section, and the offset character of the rows of louvers, may be utilized alone or in combination to form a screened gutter protection system according to various aspects of the present invention.

In some aspects of the present invention, the panel may be installed over the roof such that it forms a slight angle with the horizontal. The angle facilitates rolling off of debris away from the roof by wind or rain water.

Figure 1C:
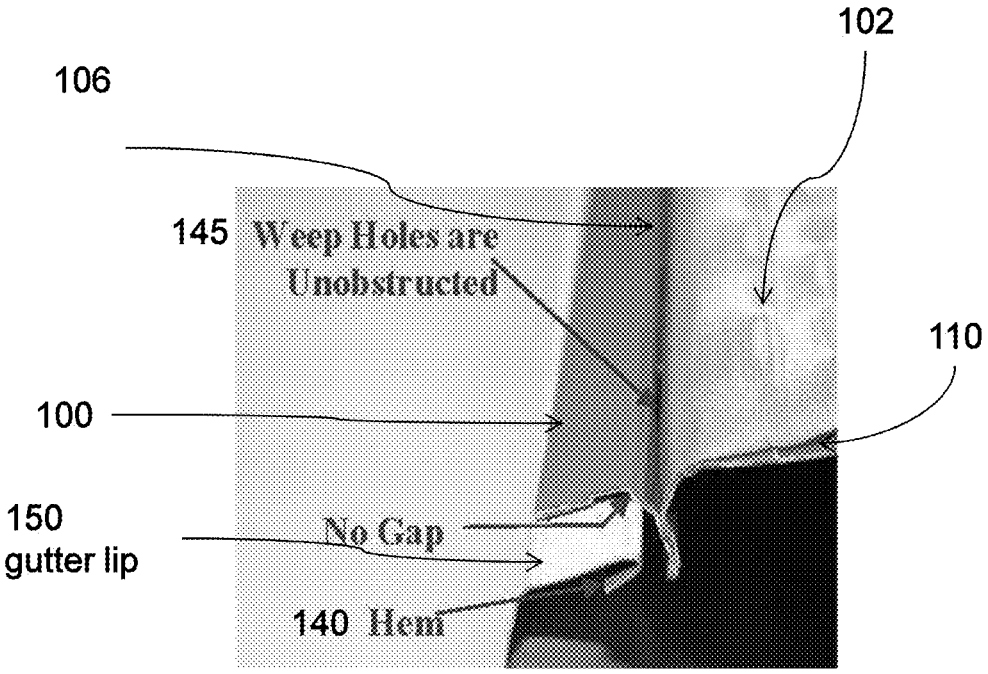
FIG. 1C shows a photograph of installation of a panel of a gutter protection system over the gutter, according to the aspects of the present invention.

FIG. 1C shows a photograph of installation of a panel of a gutter protection system over the gutter, according to the aspects of the present invention.

The photograph 1003 shows a standard K-style gutter on which the gutter lip has a hem 140. In the installation shown, the hem 140 does not obstruct the weep holes 145 from draining. To achieve this, the fastener screws should be tight enough to close the gap between the panel edge or outer portions 100 and the gutter lip 150. Properly installing and tightening the panel with fastener screws is intended to pull the lip 150 of the gutter up to the panel edge or outer portion 100, and not to bend the screen 102 up or down to match the gutter lip 150. Bending the screened panel may obstruct the weep holes 145 from draining or may cause them to drain over the gutter lip beneath the panel.

Some other recommendations for installation of the screened gutter protection system of the aspects of the present invention include: use a dissimilar metal barrier when installing panels in contact with different metals; install screws at a 90 degree angle to the panels; try not to not install screws into the roof valley; try to close all gutter or panel end caps off completely; under-the-shingle installations may use screws only in the gutter nose; over-the-shingle installations use butyl sealant in addition to 3 roof screws; fascia mounts are suitable for metal and tile roofing, or screen room installations; it is recommended to maintain a level to positive panel pitch, with no reverse slope; and notching the panel vertical leg will allow tighter end butt connections. During manufacture and installation, natural oils may adhere to the product surface and cause minor runoff on newly installed systems. This may stop after approximately 30 days of exposure.

Some panels may be easily cut to fit using sheet metal snips. Field forming for fascia mount applications may be performed using a small sheet metal hand brake. Various alternate installation methods may be used to increase the rain flow volume control capacity at inside corner valley applications. In one method, an extra piece of filter covers the corner over the two filter portions forming the corner. In another method, the extra piece of filter does not cover the filtered part of the panel portions that form the corner. Splash guards may also be utilized.

Figure 2:
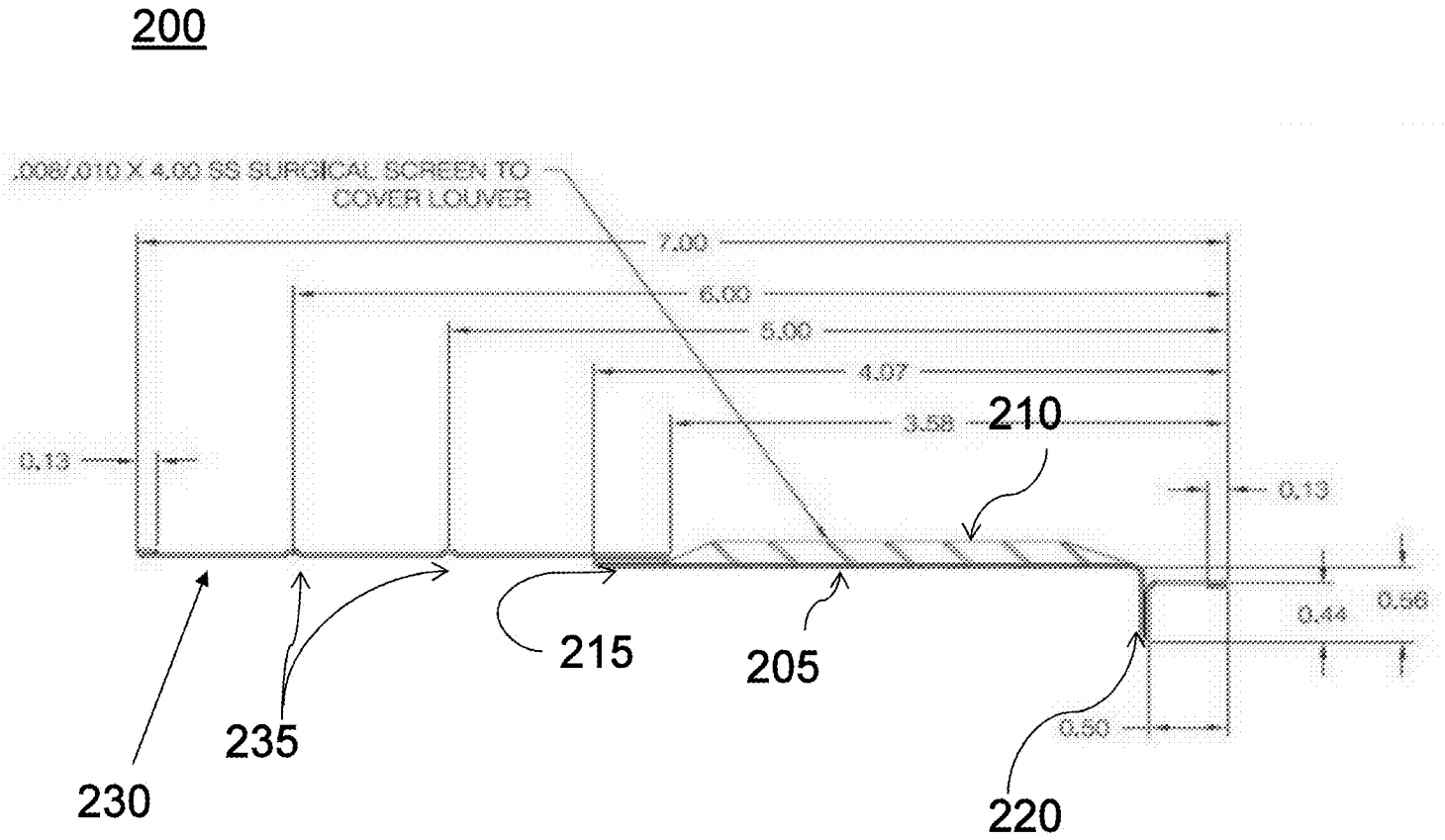
FIG. 2 shows a cross-sectional schematic drawing of an exemplary gutter protection system, according to the aspects of the present invention.

FIG. 2 shows a cross-sectional schematic drawing of an exemplary gutter protection system, according to the aspects of the present invention.

Some exemplary dimensions are marked on FIG. 2 and are in units of inches. FIG. 2 shows a screened gutter protection system 200 according to the aspects of the present invention. The system 200 includes a panel portion that is connected to a filter or screen. The panel portion includes louvered rows 205. The louvered rows 205 are covered by a molded screen 210 and end in one rolled screen locking bead 215 at one end and another rolled screen locking bead 220 at the other end. The rolled screen locking bead 215 is located at the side leading to the roof and continues in an extension 230 that includes ribs 235. The ribs 235 are used to align the screened gutter protection system with the shingles on the roof and the extension 230 is covered partially by the shingles or other roof material. The rolled screen locking bead 220 helps secure the screened gutter protection system over the gutter.

Figure 3A:
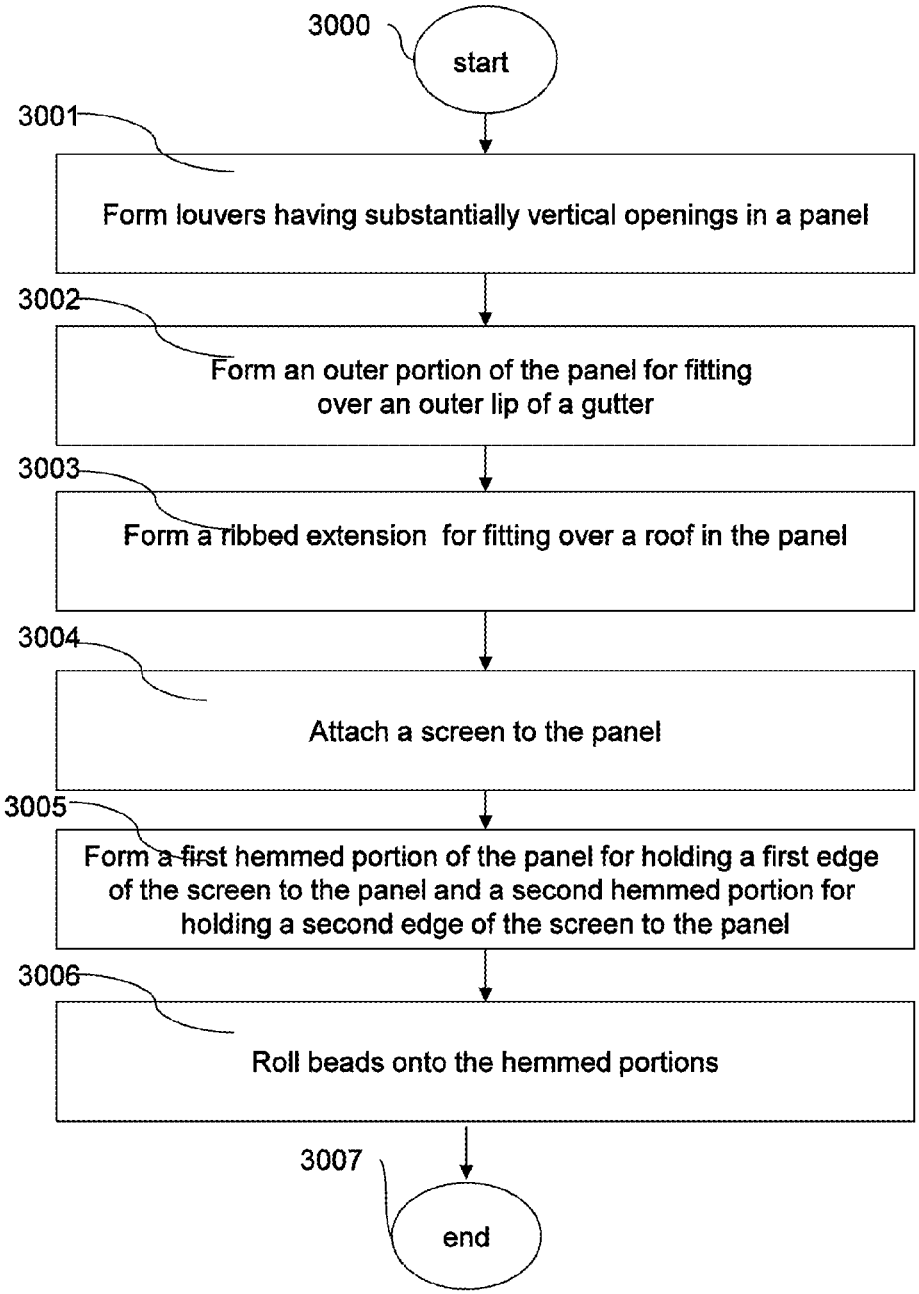
FIG. 3A shows a flowchart of a method of making a screened gutter protection system, according to the aspects of the present invention.

FIG. 3A shows a flowchart of a method of making a screened gutter protection system, according to the aspects of the present invention.

The method begins at 3000. At 3001, louvers having substantially vertical openings are formed in a panel. At 3002, an outer portion of the panel for fitting over an outer lip of a gutter is formed. At 3003, a ribbed extension is formed in the panel for fitting over a roof. At 3004, a screen is attached to the panel. At 3005, a first hemmed portion is formed in the panel for holding a first edge of the screen to the panel and a second hemmed portion is also formed for holding a second edge of the screen to the panel. At 3006, beads or ribs are rolled onto the hemmed portions to strengthen the connection between the screen and the panel. At 3007, the method ends. The above steps may be conducted in various orders. The panel may be formed having the louvers, the ribs and the hems and the screen may be attached to the formed panel at a later stage. Various portions of the panel may be formed from one continuous sheet of material or from separate parts and connected together after the screen is attached to the louvered portion of the panel. Other permutations are also possible.

Figure 3B:
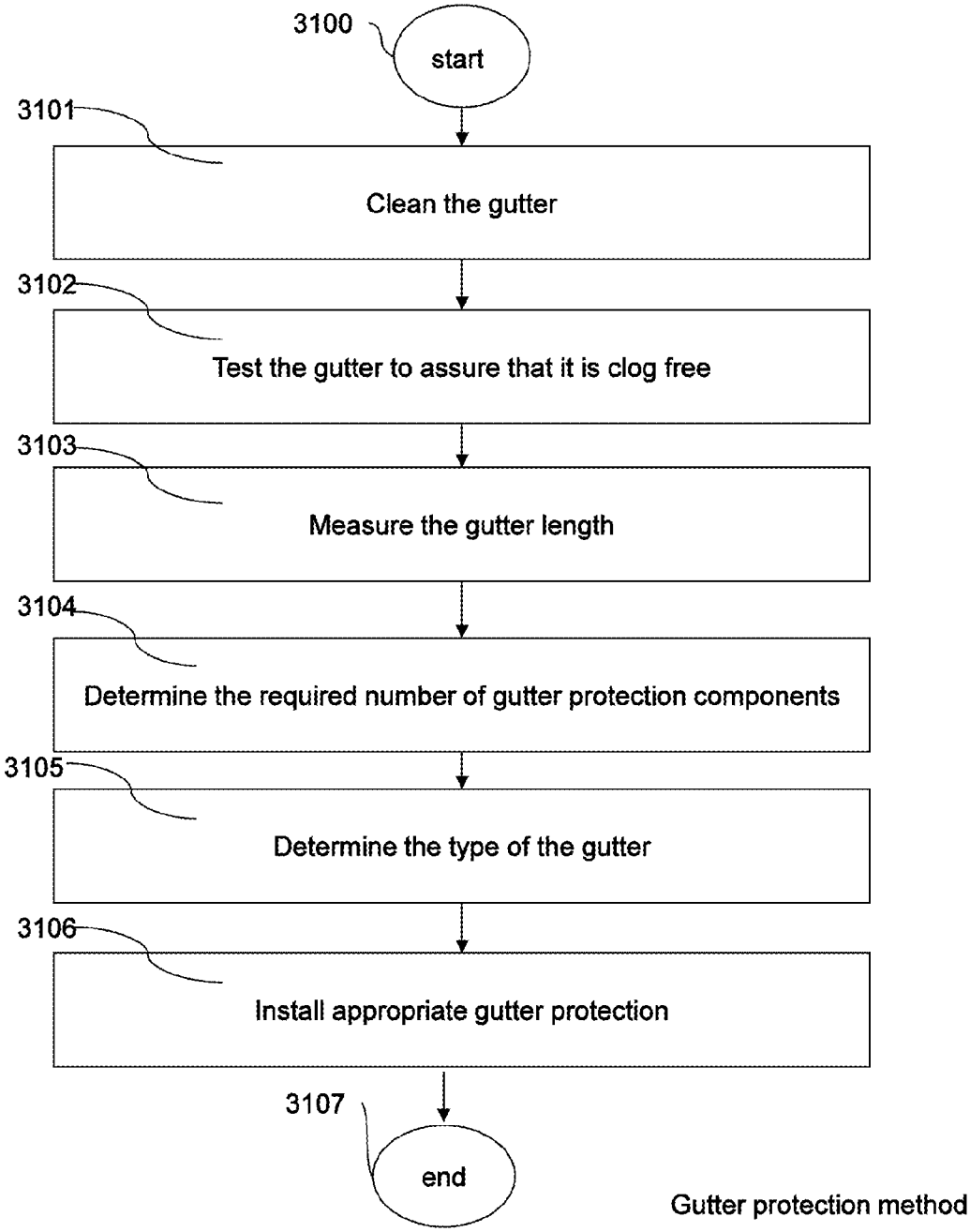
FIG. 3B shows a flowchart of a method of installing gutter protection, according to the aspects of the present invention.

FIG. 3B shows a flowchart of a method of installing gutter protection, according to the aspects of the present invention.

The method begins at 3100. At 3101, the gutter is cleaned. At 3102, the gutter is tested to assure that it is free of clogs. At 3103, the length of the gutter is measured. At 3104, it is determined how many gutter protection components are required to protect the gutter. For example, the gutter protection components may be 5'-0" long and may be trimmed with normal sheet metal cutting tools. Then, depending on the total length of the gutter, the required number of gutter protection components may be determined. At 3105, the size or type of the gutter is determined or confirmed. For example, the gutter opening is measured from the back of the gutter to the front tip. A 5" opening indicates a standard 5K and round gutter. A 6" opening indicates an oversized 6K gutter. Another type of gutter is a screen room or pool cage super gutter. At 3106, the appropriate gutter protection system is installed. At 3107, the method ends.

The gutter protection system of the aspects of present invention may be installed in several different manners. For example, the systems of the present invention provide ideal gutter protection for screen rooms or pool cages. The type of roof, the pitch, age and other factors may dictate the need for an alternative installation method. The appropriate method of installation for the type of gutter and roof that is at hand is determined by the installer and according to his judgment. When possible, the gutter protection system is installed with the back edge of the panel under the roofing material (see FIG. 4). This helps ensure better performance in most or all conditions.

Figure 4:
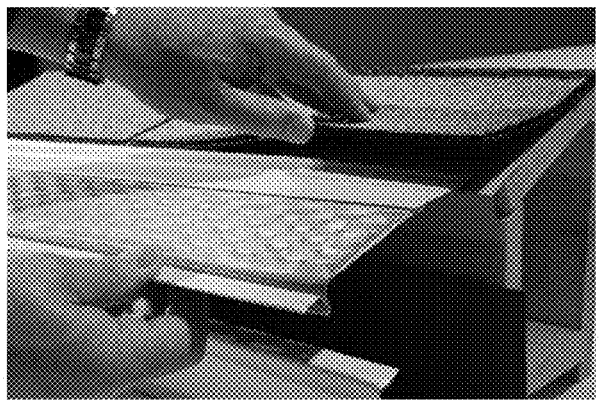
FIG. 4 shows a photograph of a method of installing gutter protection, according to the aspects of the present invention.
Figure 4:
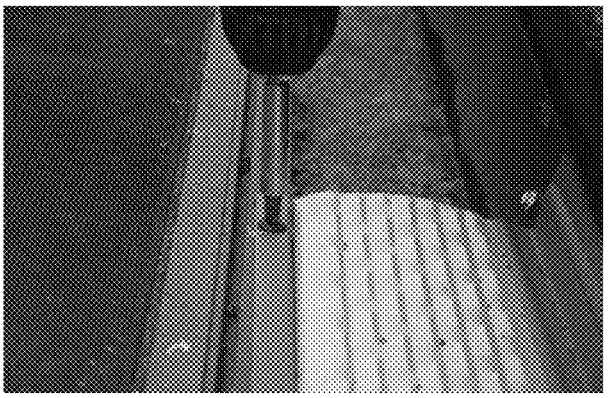

FIG. 4 shows a photograph of a method of installing a gutter protection system, according to the aspects of the present invention.

A typical rain gutter is made from aluminum. The customary method of installation of gutter protection for aluminum gutters is to slip the back edge of the gutter screen underneath the first shingle at the edge of the roof. Slipping the gutter screen under the shingle is shown at 4001 in FIG. 4.

The gutter protection system, of the aspects of the present invention, incorporates alignment ribs to locate the screen for either 5-inch or 6-inch gutters. During the installation of the gutter screen, care is exercised not to damage the roofing material, namely the shingles, tile, shake, metal or other components. For example, for asphalt shingled roofs, and particularly for an old asphalt shingled roof, it is advisable to conduct the procedure on a warm day after the sun has warmed the shingles. This way, the aged shingles may be easier to work with. If asphalt shingles have a downward bend at the overhang, the shingles are lifted gently and slowly using a wide and flat tool such as a paint scraper. Once the gutter protection system is in place, the shingles will eventually settle and flatten without having been forced to do so. The front edge of the gutter screen is positioned over the lip of the gutter.

Once in place, the panel of the gutter protection system may be secured to the gutter lip. One exemplary method of securing the gutter protection system to the gutter lip is using ½" screws that are used approximately 1" from each end and throughout the middle. For example, six ½" Hex washer head piercing point screws may be used approximately 1" from each end of the panel and in the middle of the panel. The securing of the panel in place is shown at 4002 in FIG. 4.

Specialty roofs such as shake, slate or metal often use fascia-mount installations. For fascia-mount installations, a break may be used to create a vertical 90° bend along the stiffener rib line for 5" or 6" gutters. The vertical bend along the back of the finished panel will rest flat against the fascia.

To install the screened gutter protection system around corners, one exemplary method includes butting one panel of the system in the 90° corner and another panel of the system into the side of the screened panel and securing the two panels together with two ½" screws. When corners and gutter ends need to be sealed, the ends are field fabricated using gutter flashing material. For example, a 1.5" angle may be used to block the openings secured to the panel or to the gutter by either two ⅛" by 3/16" pop rivets or two ½" screws.

Figure 5:
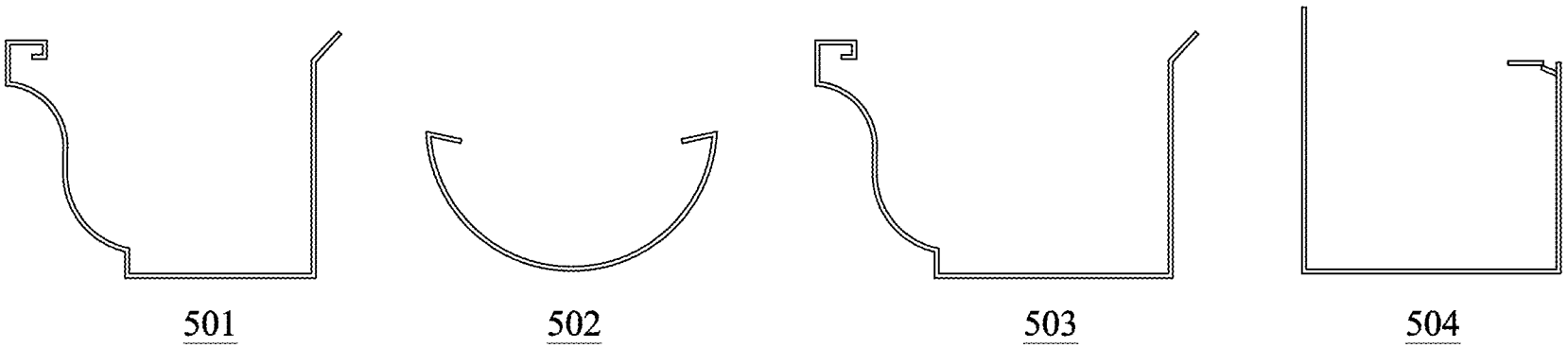
FIG. 5 shows the cross-sectional view of several types of gutters that may be covered by the gutter protection system according to the aspects of the present invention.

FIG. 5 shows the cross-sectional view of several types of gutters that may be covered by the gutter protection system according to the aspects of the present invention.

FIG. 5 shows the cross-sectional view of a 5" standard gutter 501, a 5" round gutter 502, a 6" oversized gutter 503 and a screen room or pool cage supper gutter 504. The gutters shown in FIG. 5 provide examples of gutters for which the gutter protection system of the aspects of the present invention may be employed.

Figure 6:
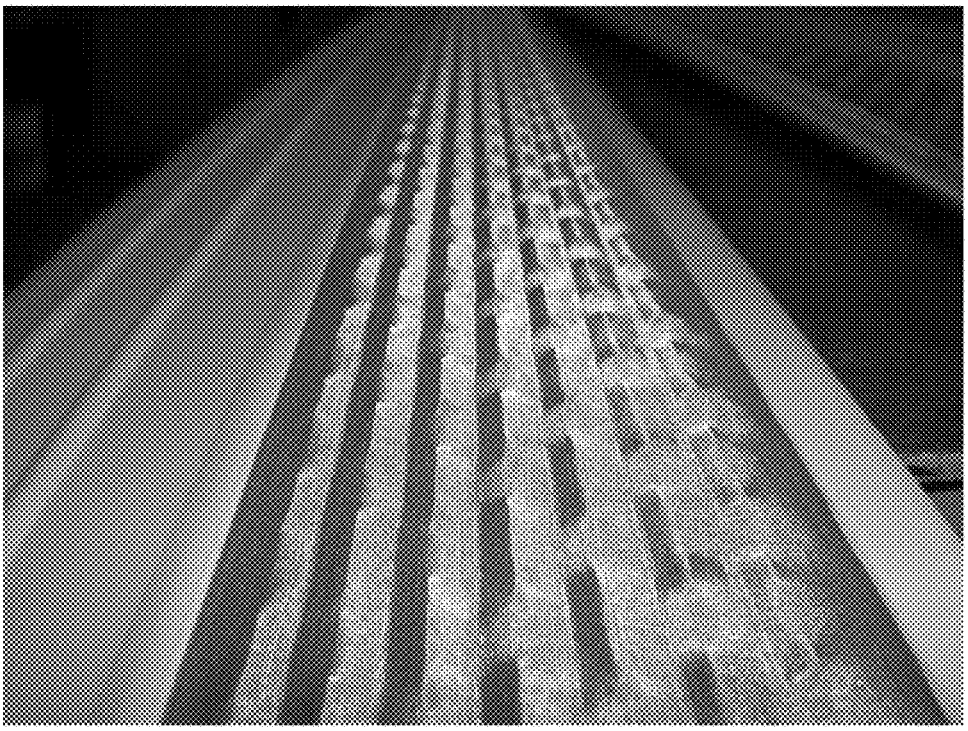
FIG. 6 shows a photograph of a molded filter screen design for a gutter protection system, according to the aspects of the present invention.

FIG. 6 shows a photograph of a molded filter screen design for a gutter protection system, according to the aspects of the present invention.

In one aspect of the present invention, the filter screen is molded to channel the rain flow to the gutter drain through the vertical openings in the louvers. The vertical openings of the louvers create a siphoning effect and molding the screen, filter or filter screen to the louvers maintains the effect created by the louvers.

Figure 7:
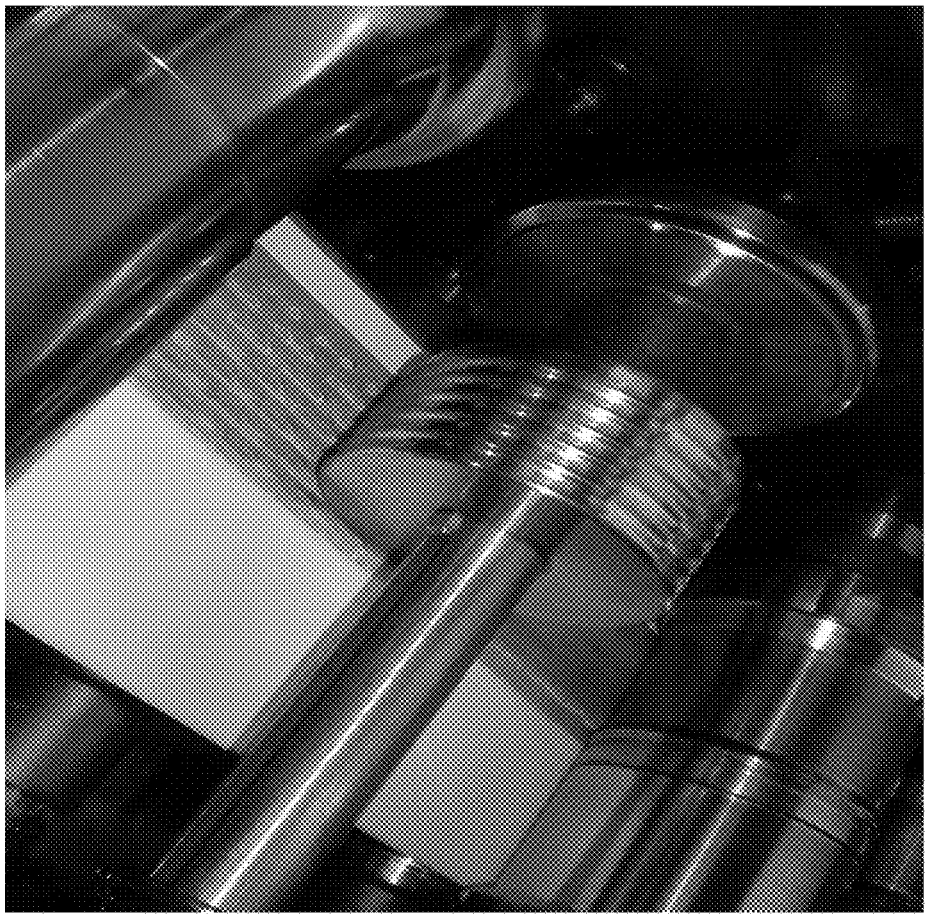
FIG. 7 shows a photograph of one method of molding the molded filter screen design, according to the aspects of the present invention.

FIG. 7 shows a photograph of one method of molding the molded filter screen design, according to the aspects of the present invention.

As shown in FIG. 6 and FIG. 7, the screen is molded to the louver rows by using a roller over a stretched screen. The molding creates channels along the louver rows that lead the rain flow to the louvers and the openings below them. The rain water is led into the gutter from the louver rows.

FIG. 8, FIG. 9, FIG. 10 and FIG. 11 present photographs showing various views of the screened gutter protection system of the aspects of the present invention.

Figure 8:
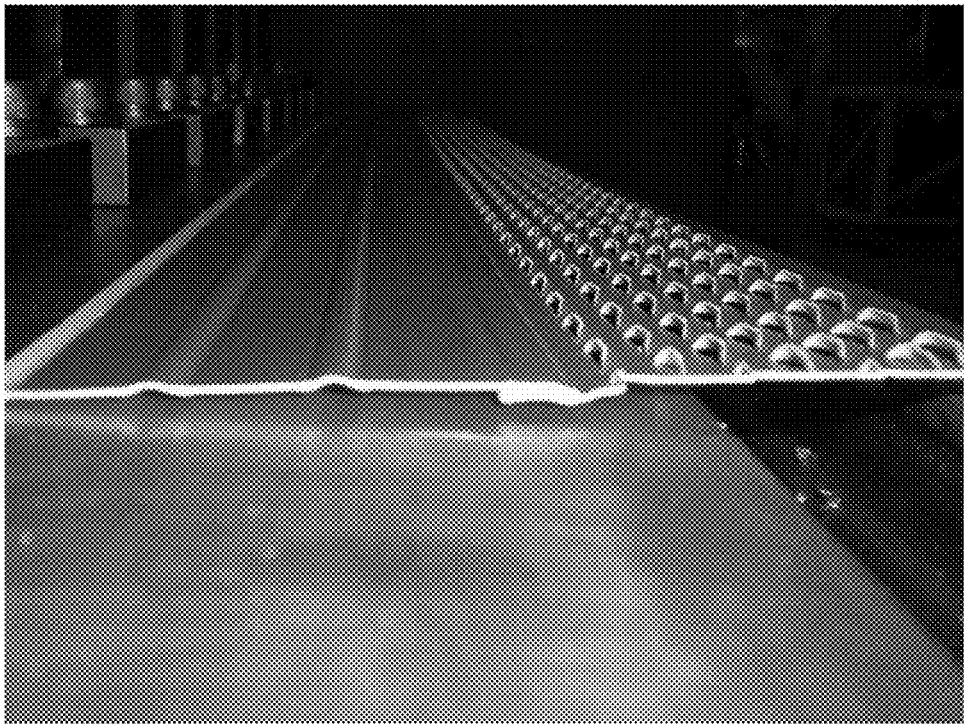
FIG. 8 shows a photograph of the louvered rows and the gutter below, according to the aspects of the present invention.

FIG. 8 shows a photograph of the louvered rows and the gutter below, according to the aspects of the present invention.

As shown in FIG. 8, the louvers stand substantially vertically to a plane of the panel to form openings that are substantially vertical to the plane of the panel. This photograph provides a view of the ribs formed in the extension portion of the panel and the rolled locking beads. In this photograph, the screen has not been attached to the panel and a clear view of the louvered rows is provided.

Figure 9:
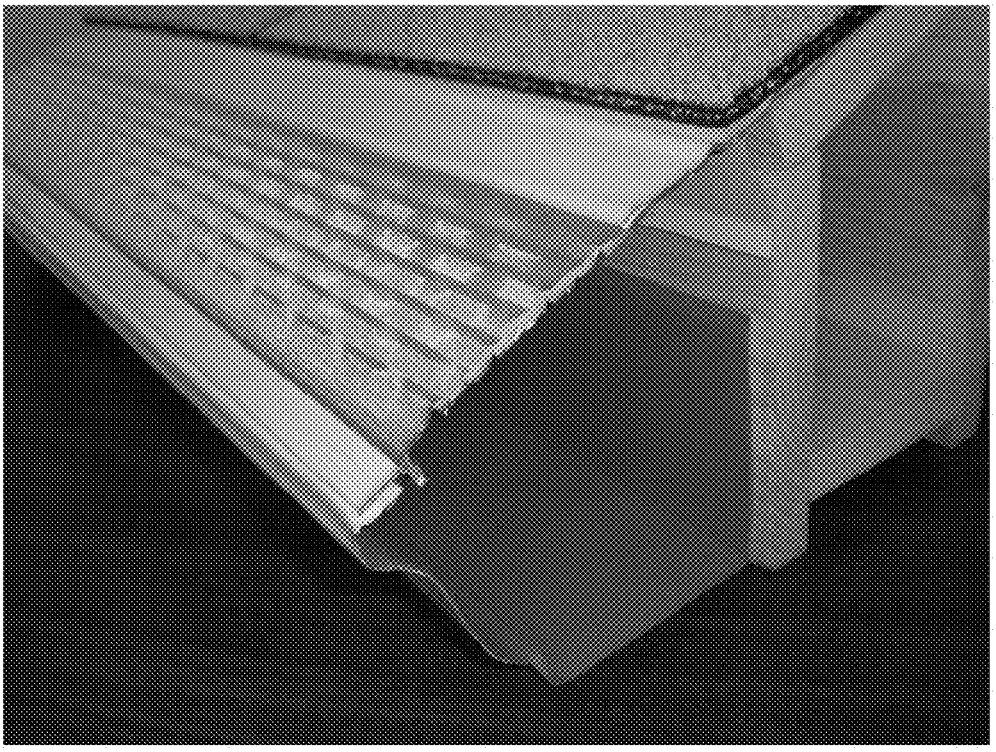
FIG. 9 shows a photograph displaying the installation of the panel of the screened gutter protection system beneath the shingle and above the gutter, according to the aspects of the present invention.

FIG. 9 shows a photograph displaying the installation of the panel of the screened gutter protection system beneath the shingle and above the gutter, according to the aspects of the present invention.

A perspective view of the cross-section of the gutter is apparent in the photograph of FIG. 9. In this photograph the screen is covering the louvers and is molded over them. Therefore, a clear view of the louvers is not provided. However, the photograph of FIG. 9 shows the extension of the panel being fitted under the roof material and the ribs being used for aligning the screened panel under the roof material.

Figure 10:
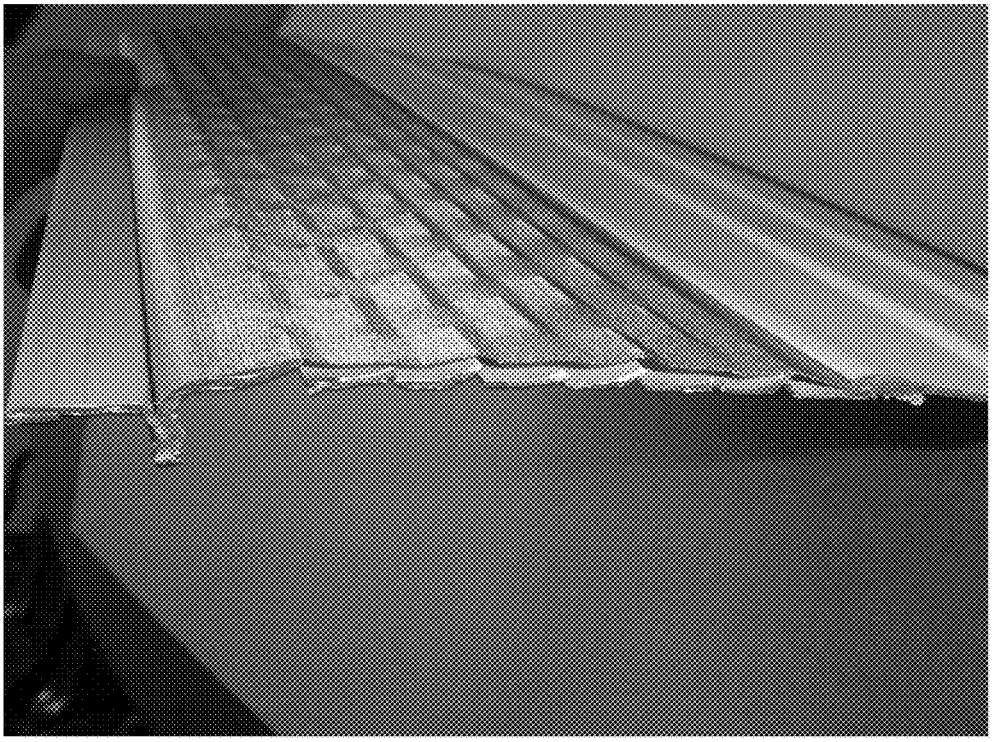
FIG. 10 shows a photograph of an end view of a gutter protection system showing a profile of the filter screen and the panel, according to the aspects of the present invention.

FIG. 10 shows a photograph of an end view of a screened gutter protection system showing a profile of the screen and the panel, according to the aspects of the present invention.

In the photograph of FIG. 10 an end edge of the screened panel is shown. The photograph shows how the screen is secured to the panel by being placed in the hems on the two sides of the louvered portion of the panel and a subsequent rolling of ribs or beads onto the hemmed portions.

FIG. 11 shows a photograph taken from beneath the panel of the gutter protection system, according to the aspects of the present invention.

In the photograph of FIG. 11 the underside of the panel is shown. This side does not include the screen. However, the underside of the holes or openings corresponding to the louvers is apparent from the photograph. Further, this photograph shows the weep hole slots along the one of the hemmed portions of the panel near the edge of the panel.

Figure 12:
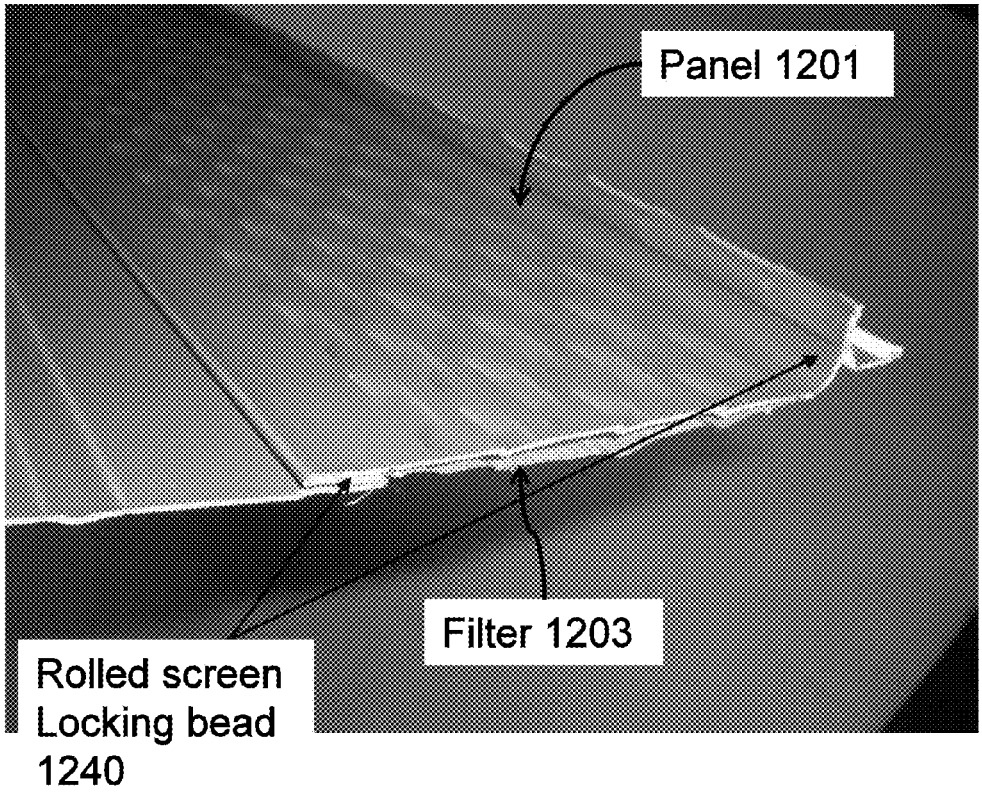
FIG. 12 shows a photograph of the gutter protection system showing rolled filter screen locking bead mechanisms, according to the aspects of the present invention

FIG. 12 shows a photograph of the gutter protection system showing the rolled screen locking bead mechanisms, according to the aspects of the present invention FIG. 12 provides a photograph showing the screened gutter protection system from below. The system includes a panel 1201 and a screen or filter element 1203. A mechanism used for attaching the filter element 1203 to the panel 1201 is shown that includes the use of a rolled screen locking bead 1240 mechanism. This method of attachment does not require the use of glue. Rather, the method of the aspects of the present invention, utilizes hems with the filter element 1203 secured to two sides of the louvered portion of the panel 1201 by addition of a continuous rolled rib or bead 1240 on each side to lock in the screen 1203.

In one method according to the aspects of the present invention, the screen is laid in opposing hems on two sides of the louvered portion of the panel. Then beads or ribs are rolled onto the hemmed portion.

The rolled in continuous beads 1240 provide a novel mechanism for locking the screen or filter 1203 to the panel 1240. The rolled in continuous beads 1240 of the aspects of the present invention are distinguished from using glue or a mere hemming of the screen to the panel.

Figure 13:
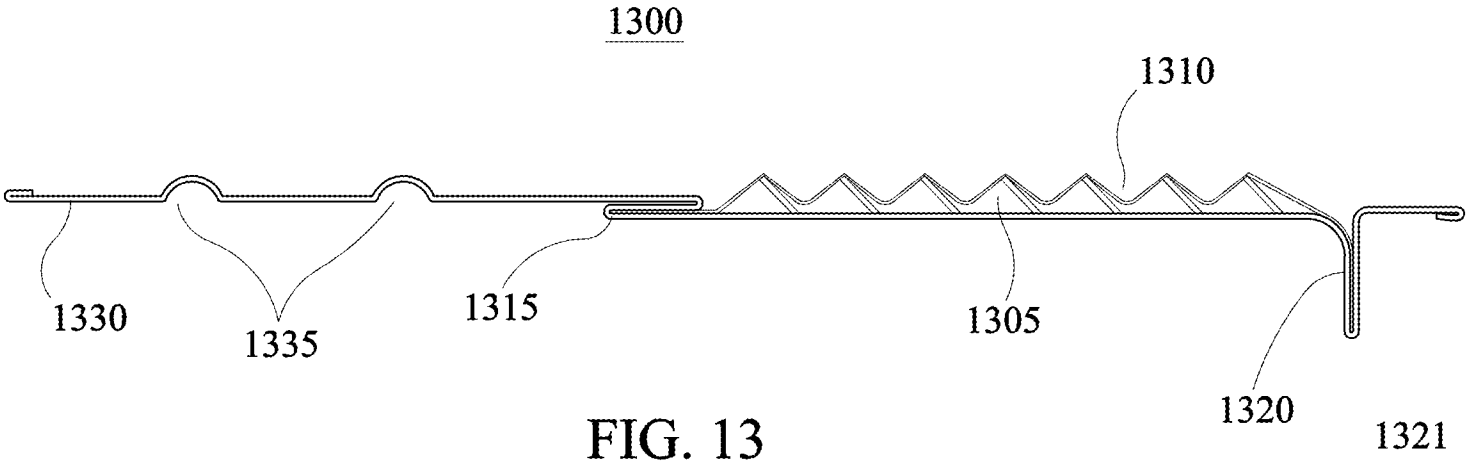
FIG. 13 shows a cross-sectional schematic drawing of another exemplary gutter protection system, according to the aspects of the present invention.

FIG. 13 shows a cross-sectional schematic drawing of another exemplary gutter protection system, according to the aspects of the present invention.

Some exemplary dimensions are marked on FIG. 13 and are in units of inches. FIG. 13 shows a screened gutter protection system 1300 according to other the aspects of the present invention. The system 1300 includes a panel portion that is connected to a filter or screen. The panel portion includes louvered rows 1305. The louvered rows 1305 are covered by a molded screen 1310 and end in one rolled screen locking bead 1315 at one end and another rolled screen locking bead 1320 at the other end. The rolled screen locking bead 1315 is located at the side leading to the roof and continues in an extension 1330 that includes ribs 1335. The ribs 1335 are used to align the screened gutter protection system with the shingles on the roof and the extension 1330 is covered partially by the shingles or other roof material. The rolled screen locking bead 1320 helps secure the screened gutter protection system over the gutter. In FIG. 13, the molded feature of the screen 1310 over the louvers 1305 is demonstrated. This drawing further shows the slotted weep hole 1321 formed in the locking bead 1320. The sizes shown on the drawing are exemplary.

Figure 14:
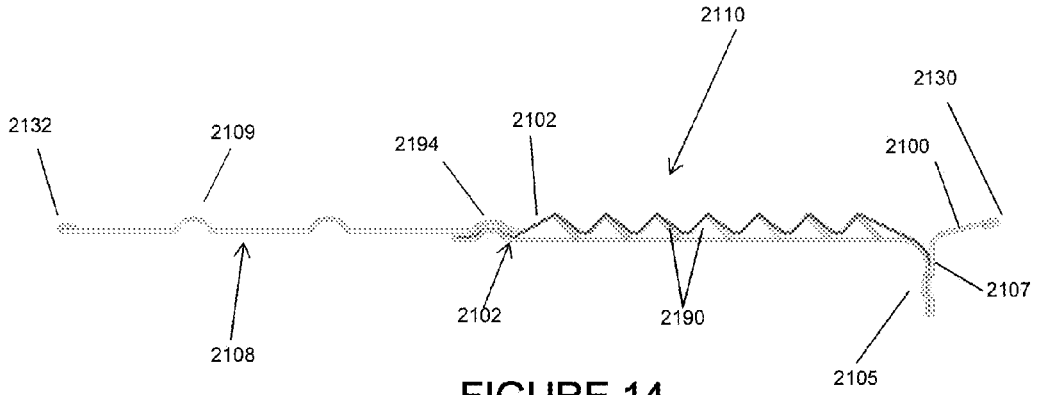
FIG. 14 shows a cross-sectional schematic of another exemplary gutter protection system, according to the aspects of the present invention.

FIG. 14 depicts a system for protection of a gutter from debris collection is depicted, the system comprising: a panel (2101) having a panel surface (2103) on the underside of the panel; and a screen (2102), wherein the panel (2101) includes at least one row of raised louvers (2190) in a louvered portion of the panel, the louvers providing openings to the gutter below, the openings being substantially upwardly vertical with respect to the panel surface (2103), wherein the screen (2103) is molded over each at least one row of raised louvers (2190). The panel includes: an outer portion (2100) fitting over a lip of the gutter. The outer portion (3100) may have an end hem (2130). The outer portion (2100) may be bent at approximately a 15 degree angle according to one embodiment. There is a first hemmed portion (2107) for connecting a first edge of the screen (2102) to the panel and extending from the outer portion (2100), the louvered portion (2110) extending from the first hemmed portion (2107), a second hemmed portion (2194) for connecting a second edge of the screen (2103) to the panel and extending from the louvered portion (2110), and an extension portion (2108) of the panel for fitting the panel on a roof and extending from the second hemmed portion (2194), the extension portion (2108) having at least one alignment rib (2109). There may also be a roll formed rib (2105) in the first hemmed portion (2107). The roll formed rib (2105) in the first hemmed portion (2107) is a profile stiffening rib that provides additional strength to the product shape, also provides an additional means of locking the screen (2103) below the weep hole that drains flow from atop the mesh filter screen. See FIGS. 11 and 13 for the weep hole. The roll formed rib (2105) in the first hemmed portion (2107) also aids in proper alignment with connection to the gutter lip and provides a drip edge to strip rain flow from beneath the louvers. There may also be an end hem (2132) in the extension portion (2108).

Figure 15:
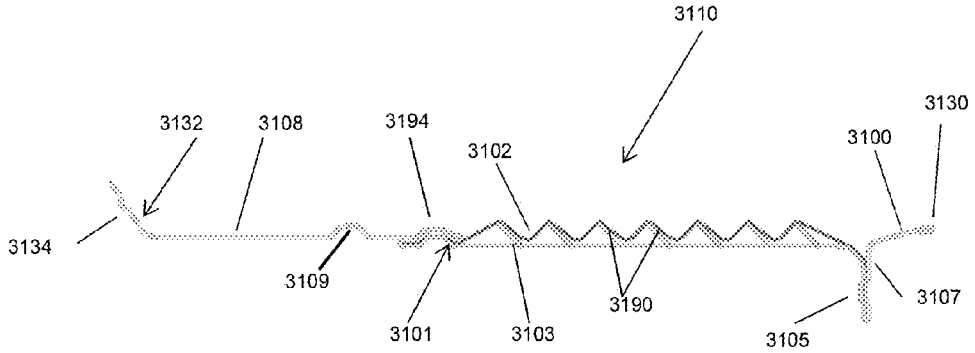
FIG. 15 shows a cross-sectional schematic of another exemplary gutter protection system, according to the aspects of the present invention.

FIG. 15 depicts a 6" fascia mount embodiment. A system for protection of a gutter from debris collection is depicted, the system comprising: a panel (3101) having a panel surface (3103) on the underside of the panel; and a screen (3102), wherein the panel (3101) includes at least one row of raised louvers (3190) in a louvered portion of the panel, the louvers providing openings to the gutter below, the openings being substantially upwardly vertical with respect to the panel surface (3103), wherein the screen (3103) is molded over each at least one row of raised louvers (3190). The panel includes: an outer portion (3100) fitting over a lip of the gutter. The outer portion (3100) may have an end hem (3130). The outer portion (3100) may be bent at approximately a 15 degree angle according to one embodiment (as shown in FIGS. 1B, 14, 15 and 16). There is a first hemmed portion (3107) for connecting a first edge of the screen (3102) to the panel and extending from the outer portion (3100), the louvered portion (3110) extending from the first hemmed portion (3107), a second hemmed portion (3194) for connecting a second edge of the screen (3103) to the panel and extending from the louvered portion (3110), and an extension portion (3108) of the panel for fitting the panel on a roof and extending from the second hemmed portion (3194), the extension portion (3108) having at least one alignment rib (3109) and a fascia mount bend (3132) for attaching the extension portion (3108) to the fascia of a roof. The fascia mount bend (3132) may be bent upward at an angle between 30 and 90 degrees for shipping and may be installed at an approximately 90 degree angle. There may be a roll formed rib (3134) in the fascia mount bend (3132). The roll formed rib (3134) in the fascia mount bend (3132) is a profile stiffening rib that provides additional strength to the shape, provides a site line groove for proper alignment and allows for rapid screw connection. There may also be a roll formed rib (3105) in the first hemmed portion (3107). The roll formed rib (3105) in the first hemmed portion (3107) is a profile stiffening rib that provides additional strength to the product shape, also provides an additional means of locking the screen (3103) below the weep hole that drains flow from atop the mesh filter screen. See FIGS. 11 and 13 for the weep hole. The roll formed rib (3105) in the first hemmed portion (3107) also aids in proper alignment with connection to the gutter lip and provides a drip edge to strip rain flow from beneath the louvers.

Figure 16:
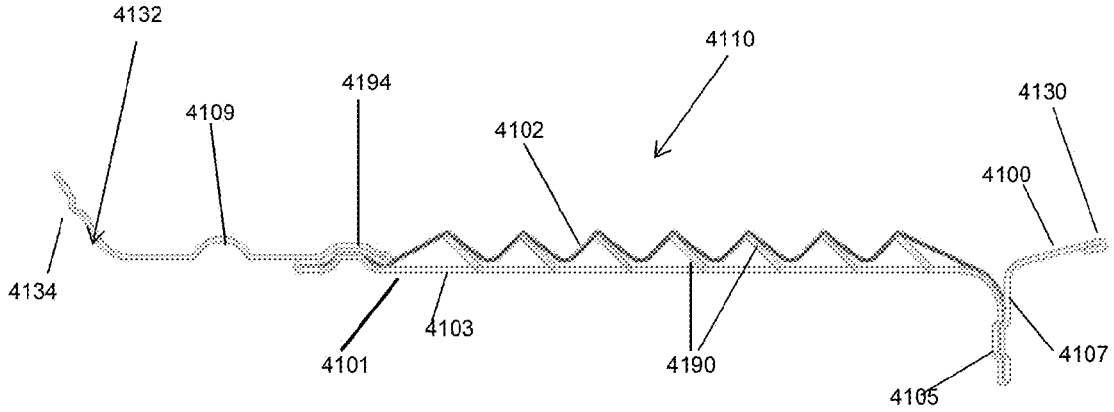
FIG. 16 shows a cross-sectional schematic of another exemplary gutter protection system, according to the aspects of the present invention.

FIG. 16 depicts a 5" fascia mount embodiment. It is basically the same as the 6" fascia mount except that the extension portion is shorter. A system for protection of a gutter from debris collection is depicted, the system comprising: a panel (4101) having a panel surface (4103) on the underside of the panel; and a screen (4102), wherein the panel (4101) includes at least one row of raised louvers (4190) in a louvered portion of the panel, the louvers providing openings to the gutter below, the openings being substantially upwardly vertical with respect to the panel surface (4103), wherein the screen (4103) is molded over each at least one row of raised louvers (4190). The panel includes: an outer portion (4100) fitting over a lip of the gutter. The outer portion (4100) may have an end hem (4130). The outer portion (4100) may be bent at approximately a 15 degree angle according to one embodiment (as shown in FIGS. 1B, 14, 15 and 16). There is a first hemmed portion (4107) for connecting a first edge of the screen (4102) to the panel and extending from the outer portion (4100), the louvered portion (4110) extending from the first hemmed portion (4107), a second hemmed portion (4194) for connecting a second edge of the screen (4103) to the panel and extending from the louvered portion (4110), and an extension portion (4108) of the panel for fitting the panel on a roof and extending from the second hemmed portion (4194), the extension portion (4108) having at least one alignment rib (4109) and a fascia mount bend (4132) for attaching the extension portion (4108) to the fascia of a roof. The fascia mount bend (4132) may be bent upward at an angle between 30 and 90 degrees for shipping and may be installed at an approximately 90 degree angle. There may be a roll formed rib (4134) in the fascia mount bend (4132). The roll formed rib (4134) in the fascia mount bend (4132) is a profile stiffening rib that provides additional strength to the shape, provides a site line groove for proper alignment and allows for rapid screw connection. There may also be a roll formed rib (4105) in the first hemmed portion (4107). The roll formed rib (4105) in the first hemmed portion (4107) is a profile stiffening rib that provides additional strength to the product shape, also provides an additional means of locking the screen (4103) below the weep hole that drains flow from atop the mesh filter screen. See FIGS. 11 and 13 for the weep hole. The roll formed rib (4105) in the first hemmed portion (4107) also aids in proper alignment with connection to the gutter lip and provides a drip edge to strip rain flow from beneath the louvers.

The present invention has been described in relation to particular examples, which are intended to be illustrative rather than restrictive, with the scope and spirit of the invention being indicated by the following claims and their equivalents.

The invention claimed is:

1. A system for protection of a gutter from debris collection, the system comprising:

a panel having a substantially flat panel surface along the underside of the panel and a louvered portion with a top end and bottom end; and a screen, wherein the panel includes at least one row of raised louvers in the louvered portion of the panel, wherein each of the raised louvers has an open side that is substantially upwardly vertical with respect to the panel surface and faces the top end of the louvered portion and a closed side that faces the bottom end of the louvered portion;

wherein the screen is placed over each of the at least one row of raised louvers;

wherein the panel includes:

an outer portion fitting over a lip of the gutter, a first hemmed portion for connecting a first edge of the screen to the panel and extending from the outer portion, the louvered portion extending from the first hemmed portion, a second hemmed portion for connecting a second edge of the screen to the panel and extending from the louvered portion, and an extension portion of the panel for fitting the panel on a roof and extending from the second hemmed portion, said extension portion having at least one alignment rib and a fascia mount bend for attaching said extension portion to the fascia of a roof.

2. The system of claim 1, further comprising a roll formed rib in said fascia mount bend.

3. The system of claim 1, further comprising a roll formed rib in said first hemmed portion.

4. The system of claim 1, wherein the panel is made from a continuous sheet, and wherein beads are rolled onto the first hemmed portion and the second hemmed portion.

5. The system of claim 3, wherein the louvers are arranged in offset rows of louvers.

6. The system of claim 5, wherein the louvered portion of the panel is dome-shaped.

7. The system of claim 6, wherein the screen is convex.

8. The system of claim 1, wherein said outer portion is bent at an approximately fifteen degree angle.

9. The system of claim 1, wherein the system is installed at an angle with respect to horizontal to facilitate rolling off of debris.

10. The system of claim 1, wherein the panel is made from metal.

11. The system of claim 1, wherein the screen is stainless steel.

12. The system of claim 1, wherein the panel is made from a continuous sheet of material, wherein the panel is made from heavy gauge 0.024 aluminum and is coated with paint, and wherein the filter screen is made from stainless steel micro mesh.

13. The system of claim 1, wherein said fascia mount bend is bent upward.

14. The system of claim 1, wherein said fascia mount bend is bent upward at an angle between 30 and 90 degrees.

15. The system of claim 1, further comprising rolling beads in at least a portion of at least one of said first hemmed portion and a second hemmed portion.

16. The system as in claim 1, further comprising an end hem on at least one of said outer portion and said extension portion.

17. The system as in claim 1, further comprising a weep hole in the first hemmed portion.

* * * * *